US006572472B1

(12) United States Patent
Glavich

(10) Patent No.: US 6,572,472 B1
(45) Date of Patent: Jun. 3, 2003

(54) GAMING DEVICE HAVING A RANDOM DIRECTIONAL BONUS SCHEME

(75) Inventor: Paulina Glavich, Reno, NV (US)

(73) Assignee: IGT, Reno, NV (US)

( * ) Notice: Subject to any disclaimer, the term of this patent is extended or adjusted under 35 U.S.C. 154(b) by 227 days.

(21) Appl. No.: 09/679,499

(22) Filed: Oct. 4, 2000

(51) Int. Cl.[7] ..... A63F 9/24
(52) U.S. Cl. ..... 463/16
(58) Field of Search ..... 463/16–22, 25–28; 273/138.1, 143 R

(56) References Cited

U.S. PATENT DOCUMENTS

| | | | | |
|---|---|---|---|---|
| 5,910,046 | A | | 6/1999 | Wada et al. |
| 5,919,088 | A | * | 7/1999 | Weiss |
| 5,931,467 | A | * | 8/1999 | Kamille |
| 5,997,400 | A | | 12/1999 | Seelig et al. |
| 6,015,346 | A | | 1/2000 | Bennett |
| 6,059,289 | A | * | 5/2000 | Vancura |
| 6,089,977 | A | | 7/2000 | Bennett |
| 6,159,097 | A | | 12/2000 | Gura |
| 6,203,429 | B1 | * | 3/2001 | Demar et al. |
| 6,296,568 | B1 | * | 10/2001 | Tracy |
| 6,406,369 | B1 | * | 6/2002 | Baerlocher et al. |

FOREIGN PATENT DOCUMENTS

| | | | |
|---|---|---|---|
| EP | 0945837 A2 | | 9/1999 |
| GB | 2090690 | * | 7/1982 |
| GB | 2106293 | * | 4/1983 |
| GB | 2153572 | * | 8/1985 |
| GB | 2181589 | * | 4/1987 |
| GB | 2225889 | * | 6/1990 |
| GB | 2242300 | * | 9/1991 |
| WO | WO 00/12186 | | 3/2000 |

OTHER PUBLICATIONS

Party Time—Cash Quest Brochure published by IGT in 1999.

Monopoly Brochures and Articles published by WMS Gaming, Inc. in 1998, 1999 and 2000.

Jackpot Party Brochures and Articles published by WMS Gaming, Inc. in 1998.

Big Bang Piggy Banking Brochure published by WMS Gaming, Inc.

* cited by examiner

*Primary Examiner*—Michael O'Neill
(74) *Attorney, Agent, or Firm*—Bell, Boyd & Lloyd LLC

(57) ABSTRACT

The present invention relates to a directional bonus scheme for a gaming device which includes a starting position, a plurality of non-terminating positions, a plurality of terminating positions, and a final terminating position. The game randomly generates a direction, of movement for a position indicator. The game awards the player with a credit value when the position indicator reaches a non-terminating position. The bonus round terminates when the position indicator reaches a terminating position. The game awards a bonus credit value to the player when the position indicator reaches a final terminating symbol.

32 Claims, 7 Drawing Sheets

GAMING DEVICE HAVING A RANDOM DIRECTIONAL BONUS SCHEME

CROSS-REFERENCE TO RELATED APPLICATIONS

This application is related to the following commonly-owned co-pending patent applications: "GAMING DEVICE WITH BONUS SCHEME PROVIDING AWARDS ASSOCIATED WITH MOVEMENTS ALONG PATH," Ser. No. 09/583,429, "GAMING DEVICE WITH A BONUS SCHEME INVOLVING MOVEMENT ALONG PATHS WITH PATH CHANGE CONDITIONS," Ser. No. 09/686,538, and "GAMING DEVICE HAVING A DESTINATION PURSUIT BONUS SCHEME WITH ADVANCED AND SETBACK CONDITIONS," Ser. No. 09/686,409.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device with a directional bonus scheme wherein players receive credits for positions randomly selected by the gaming device.

BACKGROUND OF THE INVENTION

Gaming machines currently exist with bonus schemes in which a player has one or more opportunities to choose a particular selection or symbol from a group of symbols. The player randomly chooses a symbol having a predetermined credit value. The bonus scheme either awards the player a bonus value or terminates the bonus round. The outcome depends upon each particular symbol selected by the player.

When the player selects a symbol which awards a bonus or credit value, the player receives bonus credits. Each time the player selects a symbol which awards a bonus value, the bonus scheme typically displays a message for the player to continue. This message indicates that the bonus round continues and another symbol may be selected. The gaming device selects another symbol, and this process continues until the player selects a bonus round terminator which terminates the bonus round. European Patent Application No. EP 0 945 837 A2 filed on Mar. 18, 1999 and assigned on its face to WMS Gaming, Inc. discloses a bonus scheme generally of this type. Many other bonus games are known. Since players are seeking more entertainment and enjoyment, it is desirable to provide players with new bonus schemes where the players have multiple opportunities to receive winning payouts.

SUMMARY OF THE INVENTION

The present invention overcomes the above shortcomings by providing a gaming device and method which provides players with a directional bonus scheme. The directional bonus scheme of the present invention provides a player with a plurality of positions. The gaming device randomly selects the direction of movement from a starting position to a plurality of positions and then to a terminating position.

Preferably, the majority of the positions are non-terminating positions which have credit values, where the amount of the credit values varies. Certain positions terminate the bonus round (hereinafter referred to as "terminating positions"). When the position indicator is at any non-terminating position, the game will preferably award the player with a bonus or credit value and then continue the bonus round.

In operation, the device randomly chooses a direction of movement for the position indicator (which represents the player's position). If the game directs movement to a non-terminating position, the game awards the player a bonus or credit value. As long as the player avoids a terminating position, the game randomly selects another direction of movement and moves the position indicator to such position. The player receives bonus or credit values as appropriate. This process continues until the device ultimately selects a terminating position. The gaming device thus randomly creates a bonus or credit path. Preferably, the game include a final position which awards the player with a larger bonus or credit value and terminates the game.

According to one embodiment of the present invention, the positions are represented by squares in a grid. The majority of positions are identical in size and shape. The player causes the game to randomly select a direction of movement by activating a button such as by touching a spin button on a touch screen. After the gaming device randomly chooses a direction of movement, the device moves the position indicator to the position in that direction. If the position is a terminating position, the bonus round terminates. If the position is a non-terminating position, the game awards the player with a bonus or credit value and the player is prompted to request another directional movement. It should be appreciated that the terminating positions could be positioned differently or randomly in each bonus round.

It is therefore an object of the present invention to provide a gaming device with a directional bonus scheme.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1:
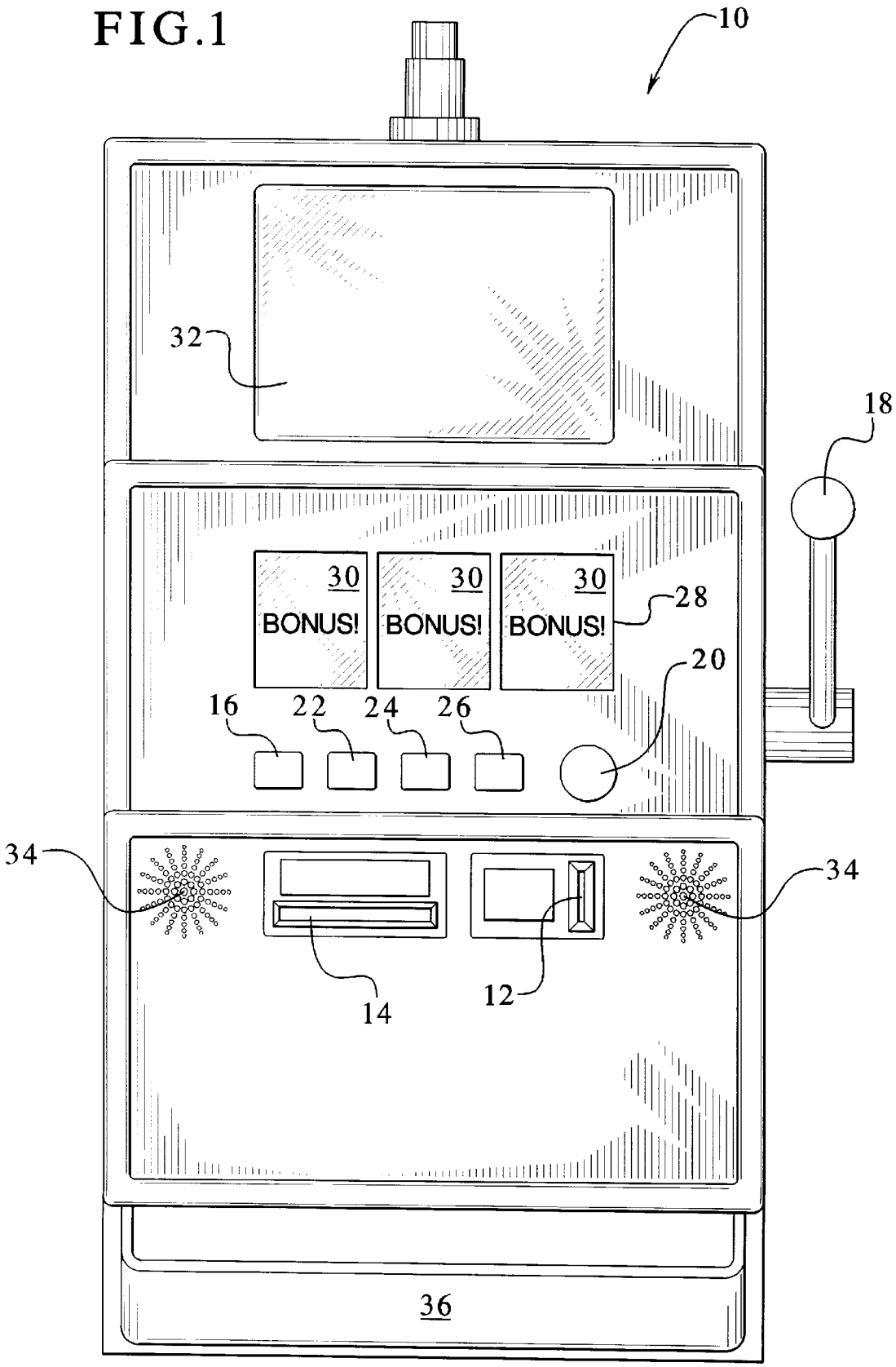
FIG. 1 is a front plan view of one embodiment of the gaming device of the present invention.

Referring now to the drawings, a gaming device 10 of one embodiment of the present invention, which is preferably a slot machine having the controls, displays and features of a conventional slot machine is generally illustrated. Gaming device 10 is constructed so that a player can operate gaming device 10 while standing or sitting. However, it should be appreciated that gaming device 10 can be constructed as a pub-style table-top game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno in addition to any of their bonus triggering events which trigger the bonus scheme of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20 or activating any other mechanism (including a touch screen) which starts the game.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at display 32 instead of at display window 28. It should be appreciated that if the indicia includes an audio response, such audio is provided through speakers 34.

The display 32 is selected from the group consisting of cathode ray tubes "CRTs", high resolution flat panel LCDs, projection type LCDs, plasma displays, field emission displays, digital micromirror displays, LCD touchscreens, flat TV displays or other suitable displays. The display 32 is capable of portraying or displaying images, symbols and other indicia including images of people, characters, places, things and card faces associated with the game. This display 32 generally attracts patrons to play the game.

In one preferred embodiment, the display 32 is an LCD which is used to display images, symbols and other indicia including secondary games which represent a bonus game (a secondary game for which a bonus is awarded to the primary game). It should be appreciated that the display window 28 containing reels 30 and display 32 could be combined into one display so that the display 32 provides the reels 30 in video form along with the images, symbols and other indicia of the gaming device 10. Furthermore, a plurality of smaller display could combine to form display 32 and used with the present invention.

At any time during the primary game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards which keep track of the player's credits.

Figure 2:
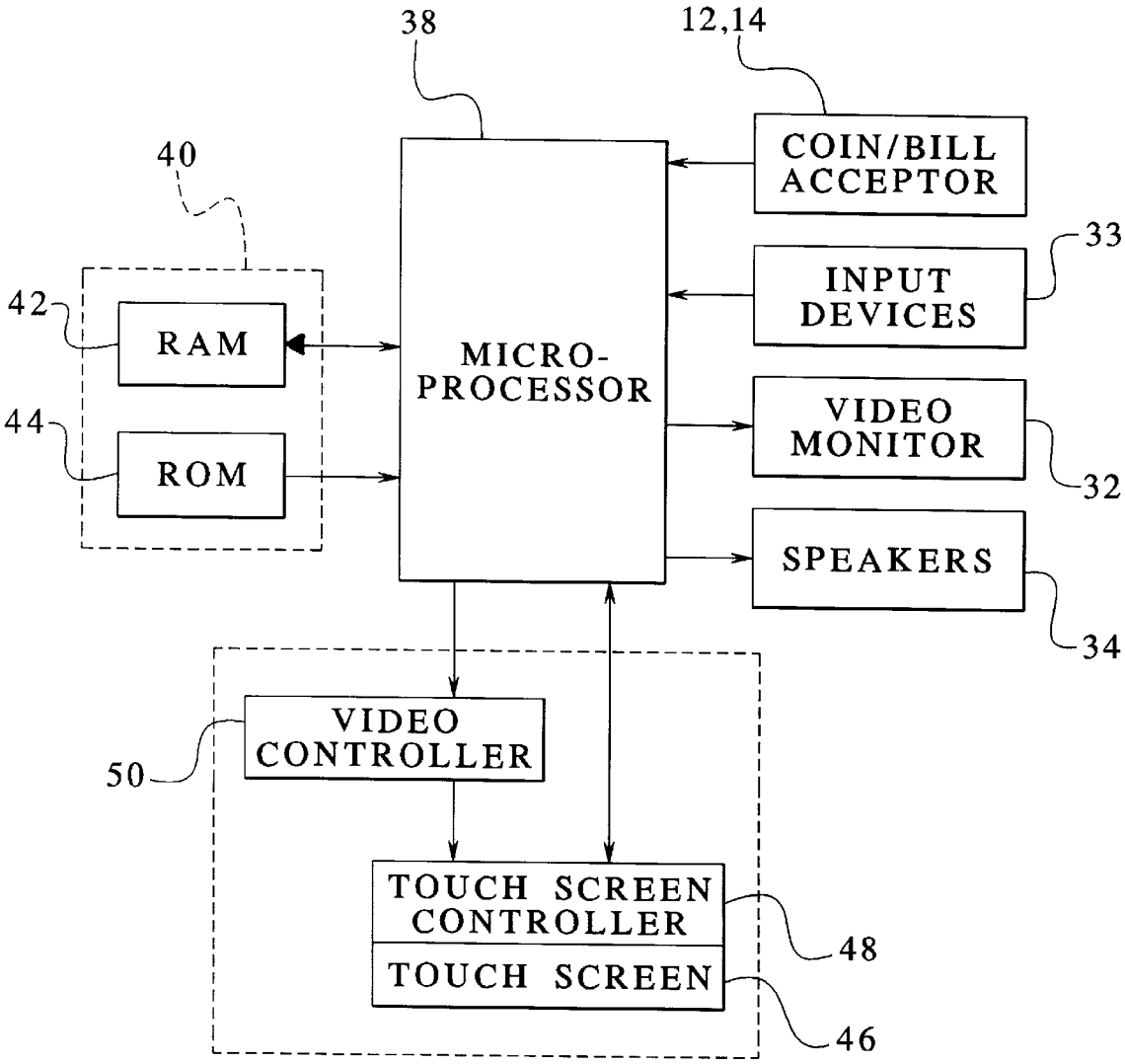
FIG. 2 is a schematic block diagram of the electronic configuration of one embodiment of the gaming device of the present invention.

With respect to electronics, gaming device 10 preferably includes the electronic configuration generally illustrated in FIG. 2, including a processor 38, a memory device 40 for storing program code or other data, a display 32 or other display device (i.e., video monitor or liquid crystal display) and at least one input device such as play buttons 20. The processor 38 is preferably a microprocessor or microcontroller-based platform which is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

As illustrated in FIG. 2, the player preferably uses input devices 33 (comprising play buttons 20 or arm 18) to input signals into gaming device 10. Furthermore, it is preferable that touch screen 46 and an associated touch screen controller 48 are used. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer" or "controller".

With reference to FIGS. 1 and 2, to operate the gaming device 10, the player must insert the appropriate amount of money or tokens at coin slot 12 or bill acceptor 14 and then activate the input device 33 (i.e., pull the arm 18 or push the play button 20). The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also provides players the opportunity to win credits in a secondary or directional bonus round. This type of gaming device 10 includes a program which automatically begins a secondary or directional bonus round when the player has achieved a qualifying condition in the game. This qualifying condition can be a particular arrangement of indicia on the display window 28. The gaming device 10 also includes a display device such as a display 32 shown in FIG. 1. The display 32 provides images and produces sounds, enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS" appearing in the same location on three adjacent reels 30 during the primary game.

Bonus Scheme

Figure 3:
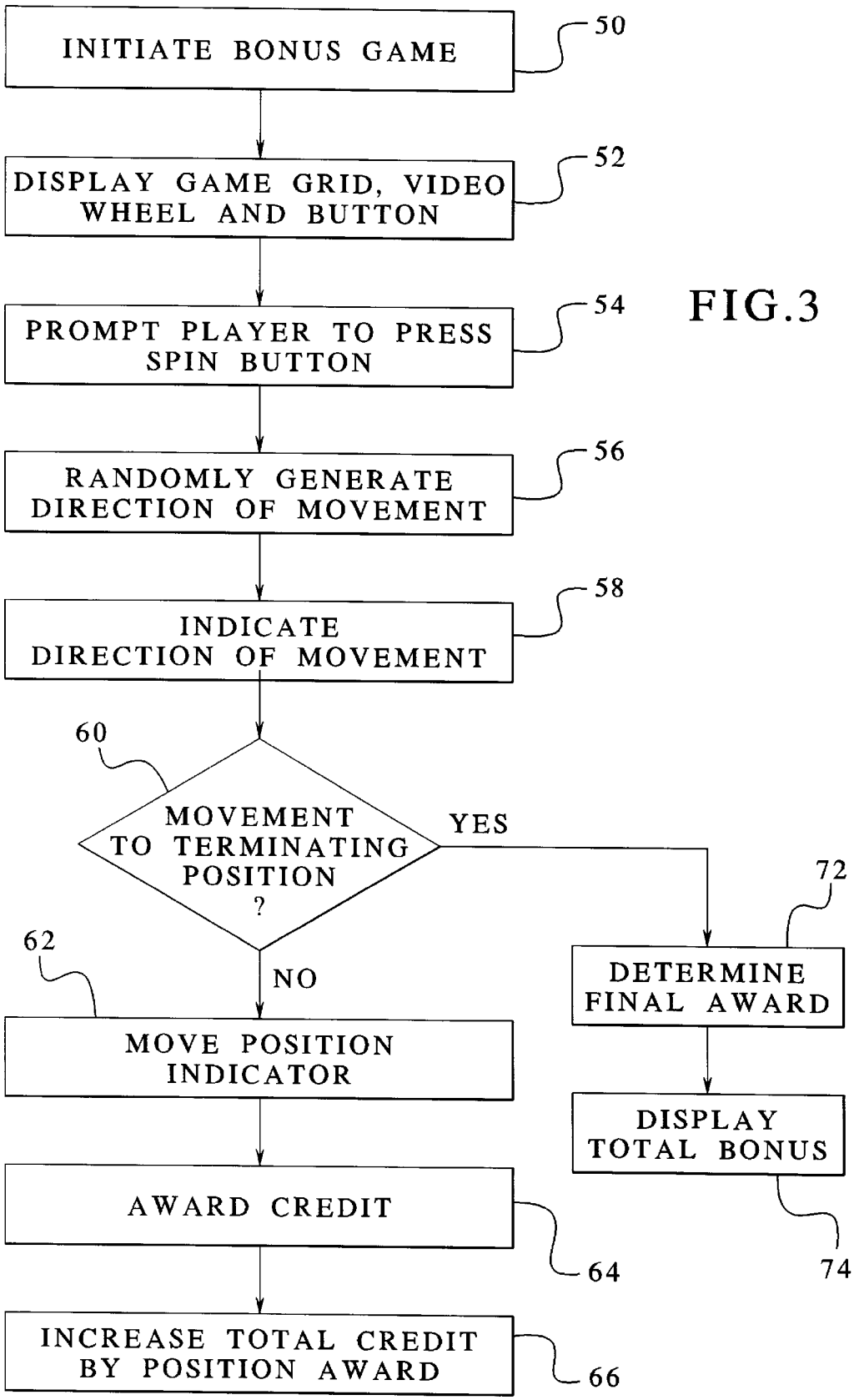
FIG. 3 is a flow diagram of one embodiment of the directional bonus scheme of the present invention.

If a player achieves a bonus triggering or qualifying condition when playing the primary game, the gaming device 10 automatically begins the bonus round of the present invention. The bonus round of the present invention initiates the bonus game as indicated by block 50 in FIG. 3. It is anticipated that the bonus game includes images consisting of various graphics and having various sizes, shapes and colors. In one preferred embodiment of the present invention, the bonus game displays squares in a grid as illustrated in FIGS. 4 to 7.

The gaming device 10 displays the game grid including the positions, directional indicator and a spin button (illustrated in FIGS. 5 and 6), as indicated by block 52. The gaming device prompts the player to press the spin button (illustrated in FIG. 5) exhibited by the display 32 as indicated by block 54. Each time the player presses the button, the gaming device randomly generates a direction of movement as indicated by block 56. The directional indicator provides the direction of movement on the grid as indicated by block 58.

In one preferred embodiment, the directional indicator has two directional arrows, and in particular an up arrow and a right arrow. The player has a fifty percent chance that the directional indicator will display the up arrow and a fifty percent chance that the directional indicator will display the right arrow. While only two arrows are preferred, other arrangements are contemplated. For example, the directional indicator could include up, down, left, right and diagonal arrows (among others) permitting more selections and varying the direction of movement.

As illustrated in FIGS. 4 to 7, the plurality of positions or the grid includes a start position, a plurality of non-terminating positions and a plurality of terminating positions. After the player presses the spin button, the directional indicator displays the arrow which indicates the direction of movement for the position indicator (i.e., either moving up or to the right starting from the starting position).

As mentioned above, the non-terminating positions or boxes preferably contain different credit values. In one preferred embodiment, the credit values are hidden by a symbol. In another embodiment, the credit values are displayed to the player. The non-terminating symbols could also be blank, could trigger other bonus events, or could include non-terminating credits which can be subsequently used during the bonus games to continue the bonus game if the player is directed to a terminating position. The plurality of terminating positions, which are preferably labeled "COLLECT," terminate the bonus round. While a plurality of terminating symbols are preferred, it should be appreciated that any desired number of terminating positions could be employed. It should also be appreciated that the terminating symbols could be randomly positioned, that the terminating positions could change each time the bonus round is played and that the terminating positions could change during the bonus game, such as after each spin or after a plurality of spins.

The non-terminating positions preferably provide credit points or values earned by the player during the bonus game. As mentioned above, these positions have different credit values which are displayed to the player during the game. As mentioned above, in an alternative embodiment the credit values could be masked. Each time the position indicator moves to a new or next position, the associated credit values are revealed. The terminating positions could also be masked.

It is further contemplated that different symbols or numbers could be used with the directional bonus game. For example, the gaming device 10 could exhibit different icons such as stars, moons and clouds where each position has a different value. Alternatively, the game could use colors where blue would have a different value from red and both these colors would have a different value from the green symbol.

Referring back to FIG. 3, the gaming device 10 terminates the bonus round when the position indicator is directed to a terminating position. Specifically, the gaming device 10 determines if the position indicator is moved to a terminating position as indicated by diamond 60. If so, the game determines and displays the player's total award as indicated in blocks 72 and 74. If not, the game continues and the position indicator moves to the non-terminating position as indicated by block 62 (i.e., highlights the non-terminating position) and awards the player the credit value, if any, associated with the non-terminating position as indicated by blocks 64 and 66. The game also maintains or highlights the previous positions of the position indicator so that a credit path is displayed. Additionally, the game changes the arrow color between the previous position and the current position which again indicates the direction of the credit path.

It should be appreciated that the terminating positions are preferably arranged such that the game does not terminate on the first play. That is, the gaming device will not initially direct the position indicator to a terminating position, and preferably directs movement to a position with a credit value and awards that credit value to the player. In the preferred embodiment, a plurality of the non-terminating positions are not adjacent to a terminating position (i.e., the position indicator cannot be directed to a terminating position from one of these non-terminating positions). The player is thus guaranteed another opportunity to move when the position indicator is in one of those non-terminating positions.

Eventually, the position indicator moves to a terminating position as indicated by the diamond 60 (i.e., a "COLLECT" position). The gaming device determines the final total for the player based on the amounts awarded previously as illustrated by box 72 and the total bonus is awarded to the player as indicated by block 74.

The preferred embodiment includes a final terminating position. If the position indicator reaches this position, the player preferably receives a larger bonus, increasing the player's current total by that bonus amount and the game terminates.

As mentioned above, it should be appreciated that the non-terminating and terminating positions are not fixed. That is, the game can rearrange the positions each time a new directional bonus round begins. This rearrangement prevents the positions from being located in the same place on the display from bonus round to bonus round. This adds to the excitement and prevents the player from getting bored by playing the same game. The random selection of the directional indicator adds excitement and enjoyment to the game.

In one preferred embodiment of the present invention, display 32 displays the directional bonus game 80. The directional bonus game 80 of the present invention exhibits a plurality of positions 82 displayed in a seven by seven grid 88. The non-terminating position 82 have points or credit values 84 the player can earn.

Grid 88 includes a total of 46 positions comprising 29 non-terminating positions (i.e., having credit value) and 17 other positions. The other positions comprise one start position 90 and 16 terminating positions 92. Each of the positions includes a display area 94 and a frame 96. For the non-terminating positions, the display area 94 contains the appropriate credit value 84. The display area 94 for the start position 90 preferably exhibits the term "START." The display area 94 for the terminating position 92 preferably exhibits the term "COLLECT." The display area 94 for the final terminating symbol 98 contains the phrase "COLLECT 750." This symbol 98 is the end point of the game which awards the player additional bonus credit value if reached.

The game uses the position indicator to successively indicate the positions 82 as based on the directional indicator. The positions create a credit path 100 (illustrated in FIGS. 5 through 7). At least one arrow 102 is associated with each non-terminating position 82. Each arrow 102 indicates the next possible position or possible direction for the credit path. In the illustrated embodiment, two arrows 102 are associated with each non-terminating position 82. The two arrows are transverse to each other. In the preferred, embodiment, up and right arrows 102A and 102B, respectively, are associated with each non-terminating position.

The gaming device 10 selects a directional indicator from the arrows located above and to the right of the currently indicated positions 82. Each of these two arrows has an equal chance of being selected. Each successive position 82 is indicated. If the gaming device 10 selects a non-terminating symbol, the display 32: (i) pops out the position 82, adding a 3-D effect; (ii) highlights the position 82 by lighting the frame 96; (iii) changes the color of the arrow 102 associated with the position; (iv) grays out the credit value 84 exhibited in the credit box 86; and (v) increases the player's current total by the credit value 84. It should be appreciated that popping out the position 82, highlighting the position 82, changing the color of the arrow 100 and graying out the credit value 84 creates the credit path 100 as discussed previously.

The start position 90 exhibits the label "START", the display area 94 for the terminating position 92 exhibits the label "COLLECT", while display area 94 for the end of the final terminating position 98 contains the label "COLLECT 750." This position 98 is the end point of the game 80, awarding the player additional bonus credit value if reached.

It should be appreciated that the players object is to earn as many bonus points (i.e., credit values 84) as possible. Therefore, the object of the bonus game 80 is to reach the final terminating position 98 before any of the other terminating position 92.

Figure 4:
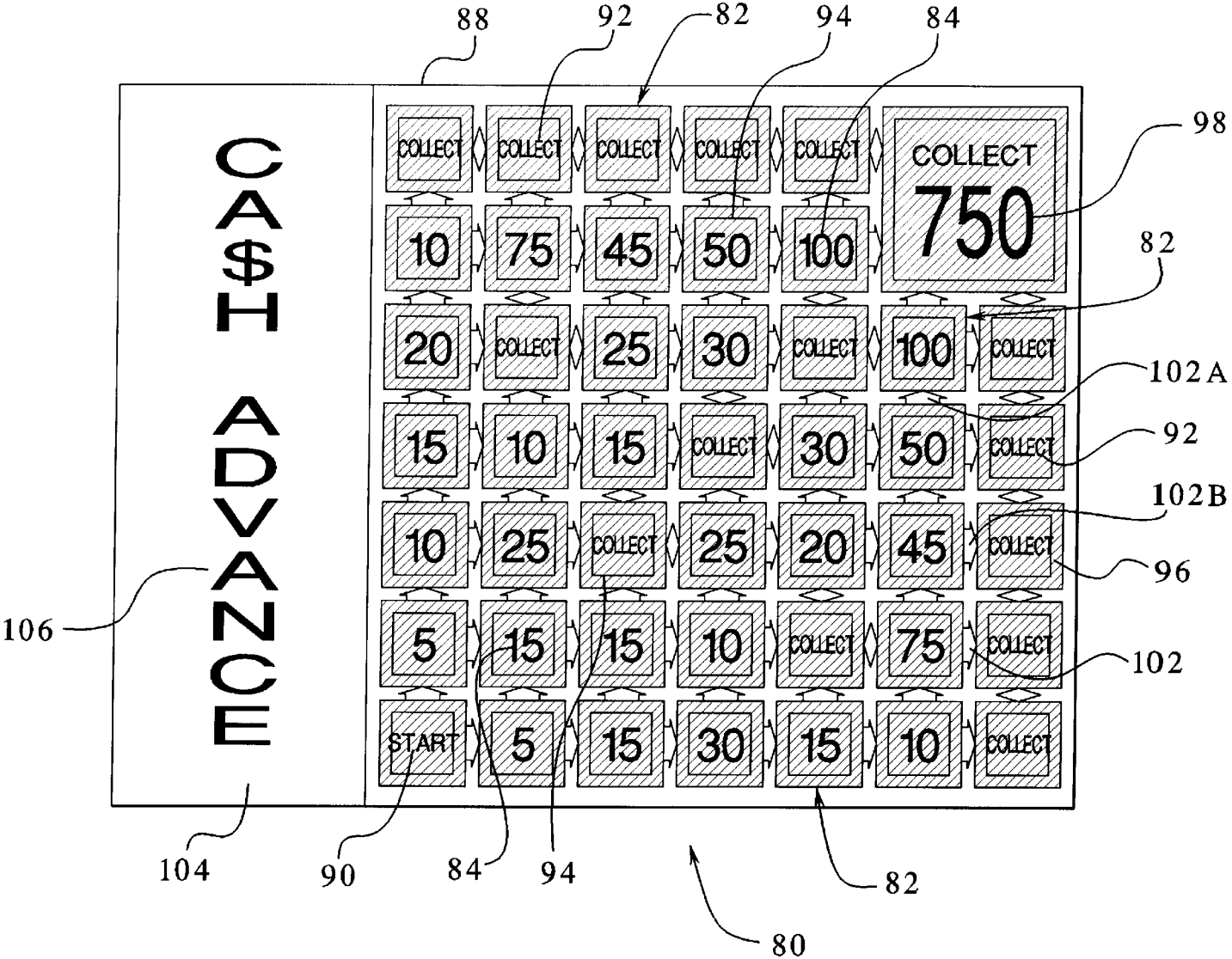
FIG. 4 is a plan view of the grid and positions in one embodiment of the bonus scheme of the present invention.
Figure 5:
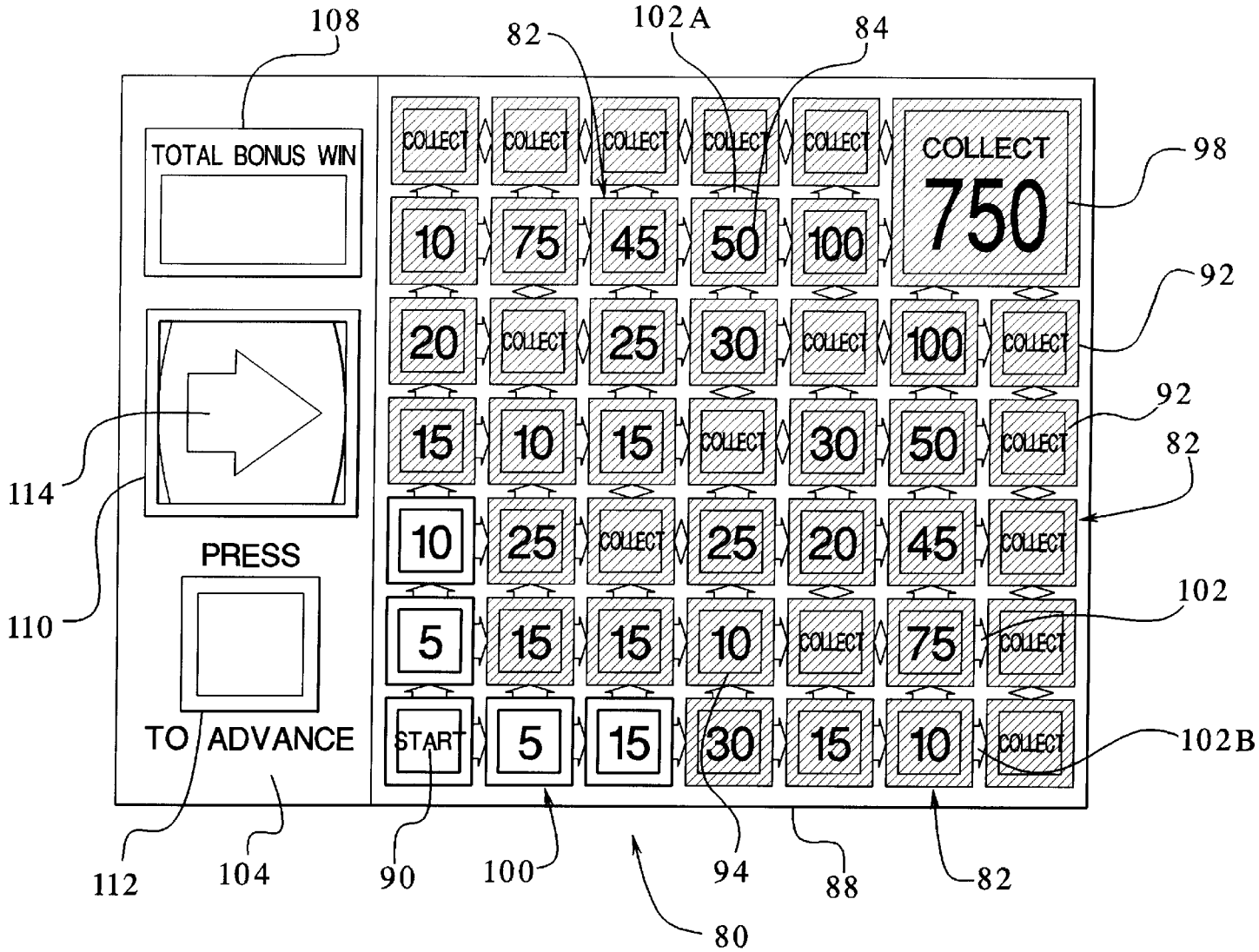
FIG. 5 is a second plan view of the grid and positions of the present invention depicting the direction indicator and a credit path.
Figure 6:
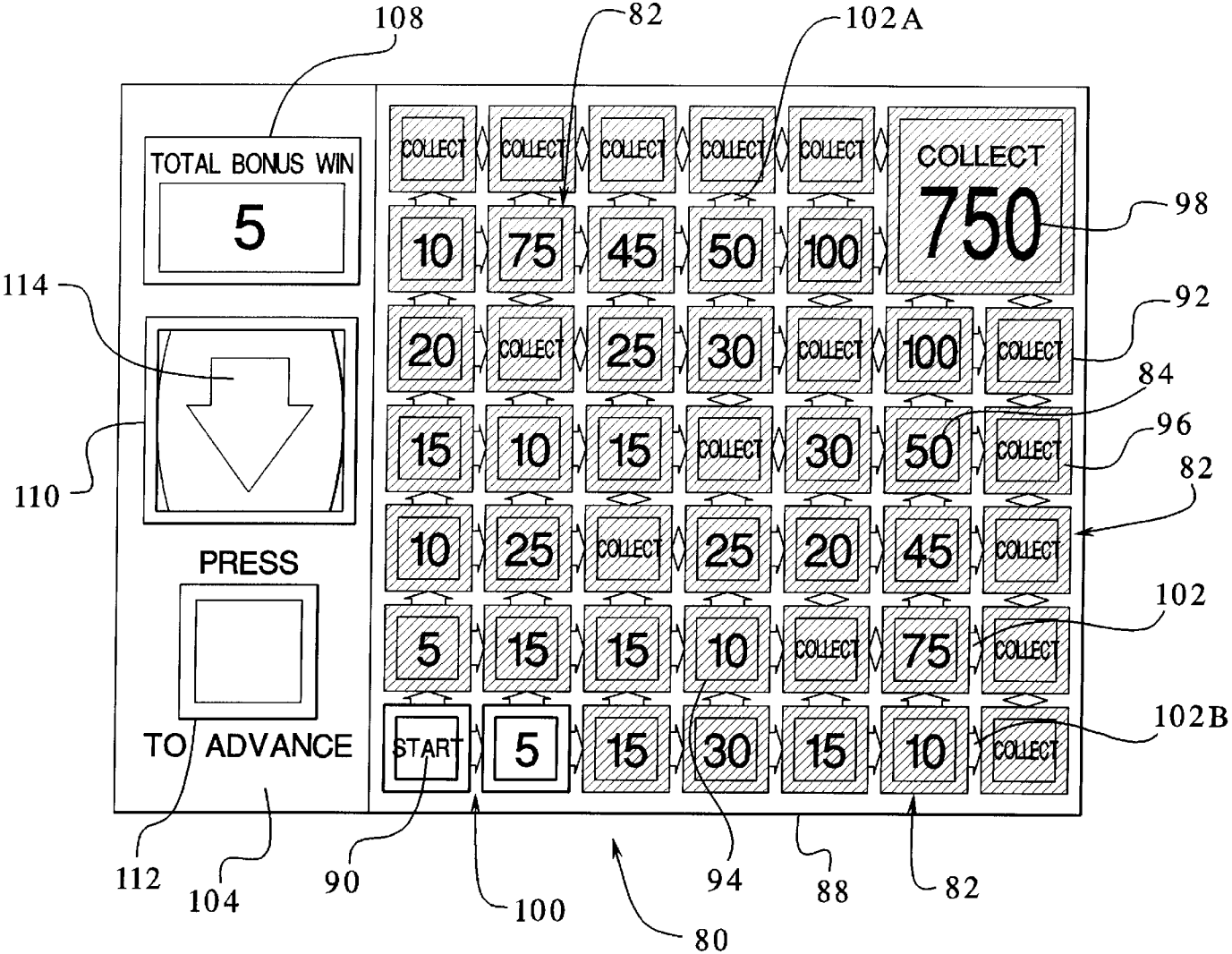
FIG. 6 is a third plan view of the grid and positions of the present invention depicting selecting the position and the credit value.
Figure 7:
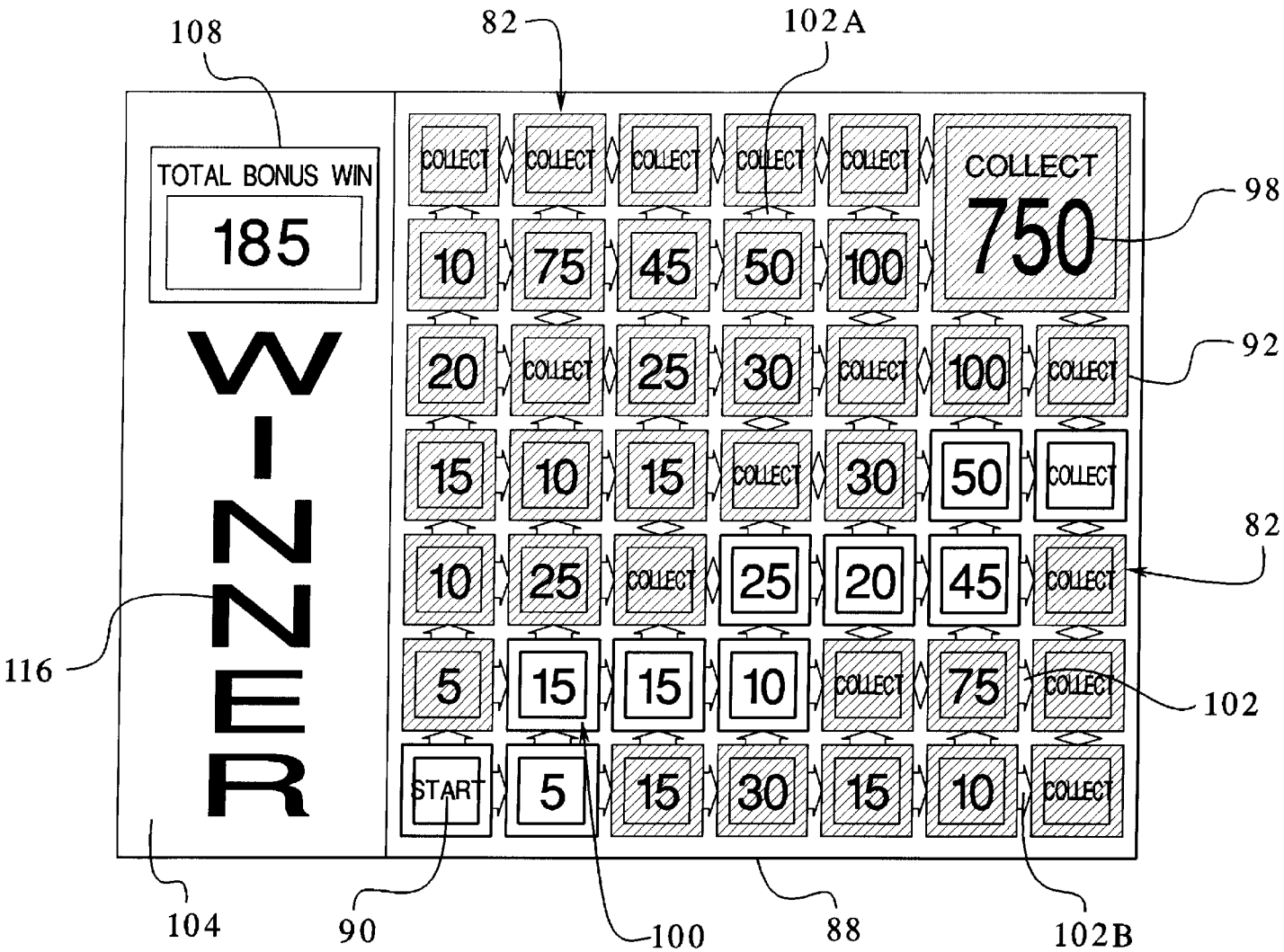
FIG. 7 is a fourth plan view of the grid and positions of the present invention depicting winning the bonus game.

Display 32 includes a non-grid area 104 for exhibiting other features of the bonus game 80. The non-grid area 104 displays a flag 106 advertising the name of the bonus game 80. In this embodiment, flag 106 includes the phrase "CASH ADVANCE" as illustrated in FIG. 4. CASH ADVANCE is a trademark of the assignee of this application and is not part of the present invention. The non-grid area 104 includes a credit value meter 108, directional indicator 110 and the spin button 112 as illustrated in FIGS. 5 and 6. The value meter 108 displays a running total of all credit values (i.e., current total) as they are earned. Upon reaching a terminating symbol, the value meter displays the final total including any bonus credit values as appropriate.

The directional indicator 110 displays an indicator or arrow 114 that indicates the direction of the next movement. In the preferred embodiment, the directional indicator 110 includes up and right arrows, where each arrow has a fifty percent chance of being displayed as illustrated in FIG. 5. It should be appreciated that FIG. 5 does not illustrate two credit paths, rather FIG. 5 illustrates alternative methods of displaying the credit paths 100 (i.e., up or to the right). However, it should also be appreciated that other directions are contemplated (i.e., down, diagonal, etc.). The button 112 initiates the spinning of the direction indicator 110 and the selection of the arrow 114 as discussed previously.

The non-grid area 104 also includes a second flag 116 signaling the termination of the bonus game 80. In the preferred embodiment, the non-grid area 104 exhibits the value meter 108 containing the final total as earned by the player and a second flag 116 including the phrase "WINNER." It should be appreciated that upon displaying this second flag 116, the display device 10 returns to the primary game.

The bonus game of the present invention offer players a heightened level of excitement because the game offers the player a plurality of credit paths through the grid to obtain the large bonus and the outcome is completely randomly determined.

In one alternative embodiment of the present invention, the game awards the player with a consolation value. The game awards a player with a consolation value when the bonus round terminates and preferably when the position indicator reaches a terminating position. The consolation value can be any predetermined or randomly generated value.

In another alternative embodiment of the present invention, the game awards the player with a bonus value for reaching certain non-terminating unrelated or related positions. It should be appreciated that this bonus value can be any amount and can be determined in any manner. For example, this bonus value can be the product of a predetermined numeric factor (i.e., two) multiplied by the sum of all values awarded to the player thus far in the bonus round. In another example, this bonus value can be any predetermined number.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device having a directional bonus round, said gaming device comprising:

a plurality of fixed non-terminating positions;

a plurality of fixed terminating positions, wherein each of said terminating positions is adjacent to at least one of the non-terminating positions;

a position indicator;

a display device operable to display the plurality of non-terminating positions, the plurality of terminating positions, and the position indicator; and a controller operable with the display device to sequentially randomly determine a direction and cause the position indicator to move to one of the adjacent positions in the determined direction until said position indicator moves to one of the terminating positions.

2. The gaming device of claim 1, which includes a starting position.

3. The gaming device of claim 2, which includes a final terminating position.

4. The gaming device of claim 1, which includes a direction indicator, wherein the controller causes the direction indicator to display the randomly determined direction.

5. The gaming device of claim 4, wherein the direction indicator is adapted to display at least two directions.

6. The gaming device of claim 5, wherein said directions are tangential to each other.

7. The gaming device of claim 4, wherein said display device displays the direction indicator.

8. A gaming device having a directional bonus scheme comprising:

a plurality of fixed credit positions;

a plurality of fixed terminating positions, wherein each of said terminating positions is adjacent to at least one of the credit positions;

a starting position not at any terminating position;

a position indicator;

a display device operable to display the credit positions, the terminating positions, the starting position, and the position indicator; and a controller operable with the display device to initially display the position indicator at said starting position, and sequentially randomly determine a direction and cause the position indicator to move to one of the adjacent positions in the determined direction until said position indicator moves to one of said terminating positions.

9. The gaming device of claim 8, which includes a direction indicator, wherein the controller causes direction indicator to display the determined direction.

10. The gaming device of claim 8, wherein a plurality of said credit positions have different values.

11. The gaming device of claim 8, wherein the position indicator can only move to one of the credit positions from at least one other credit position.

12. A method for operating a directional bonus round of a gaming device, said method comprising the steps of:

(a) triggering said bonus round;

(b) displaying a plurality of fixed non-terminating positions and a plurality of fixed terminating positions;

(c) using a processor to randomly determine and provide a direction of movement;

(d) displaying a position indicator at one of the non-terminating symbols or one of the terminating positions based on said direction of movement;

(e) determining if the position indicator is at a non-terminating position and if so, awarding a player an award associated with said non-terminating position; and (f) repeating steps (c) through (e) until the position indicator reaches one of the terminating positions.

13. The method of claim 12, wherein the step of providing the direction of movement includes displaying a direction indicator showing the direction of movement.

14. The method of claim 12, which includes creating a path of position indicators.

15. The method of claim 12, which includes displaying a starting position where the position indicator starts and a final terminating position, where the position indicator ends if the position indicator does not reach a terminating position.

16. The method of claim 12, which includes providing masked non-terminating positions and masked terminating positions and enabling the player to select the direction of movement.

17. A gaming device comprising:

a game having a plurality of fixed positions which includes a plurality of termination positions and a plurality of non-termination positions;

a position indicator which is enabled to move to each of the plurality of fixed positions;

a directional indicator;

a display device operable to display the plurality of fixed positions and the position indicator; and a processor operable with the display device to sequentially randomly select a direction, cause the directional indicator to display the selected direction, cause the position indicator to move to one of the fixed positions in the direction displayed by the directional indicator, and if the position indicator moves to one of the termination positions, cause the game to terminate.

18. The gaming device of claim 17, which includes a player input device, wherein upon activation of the player input device, the processor randomly selects the direction, causes the directional indicator to display the selected direction, and causes the position indicator to move to one of the fixed positions in the direction displayed by the directional indicator.

19. The gaming device of claim 17, which includes a starting position.

20. The gaming device of claim 17, which includes a final termination position.

21. The gaming device of claim 20, wherein the final termination position is associated with a jackpot award.

22. The gaming device of claim 17, wherein each non-termination position is associated with an award.

23. The gaming device of claim 17, wherein the directional indicator is operable to display at least two directions.

24. The gaming device of claim 17, wherein the directions selected by the directional indicator are tangential to each other.

25. The gaming device of claim 17, wherein the plurality of fixed positions are masked and the controller causes one of the masked fixed positions to reveal whether it is one of the non-termination or one of the termination positions when the position indicator is moved to said fixed position.

26. A method for operating a game of a gaming device, the method comprising:

(a) triggering the game;

(b) displaying a plurality of fixed positions, a direction indicator and a position indicator, wherein the plurality of fixed positions includes a plurality of non-terminating positions and a plurality of terminating positions, and the position indicator is enabled to move to each of said plurality of fixed positions;

(c) using a processor to randomly select a direction and cause the direction indicator to display the selected direction;

(d) moving the position indicator to the fixed position in the selected direction; and (e) repeating steps (c) through (d), until the position indicator moves to one of the terminating positions.

27. The method of claim 26, which includes a player input device and enabling a player to initiate steps (c) through (e).

28. The method of claim 26, which includes the step of providing an award to a player if the position indicator is moved to one of the non-terminating positions.

29. The method of claim 26, which includes a final terminating position.

30. The method of claim 29, which includes the step of providing a jackpot award to a player if the position indicator is moved to the final terminating position.

31. The method of claim 26, which includes displaying a starting position where the position indicator starts at the beginning of the game.

32. The method of claim 26, wherein the plurality of fixed positions are masked, and which includes revealing one of the masked fixed positions when the position indicator moves to said masked fixed position.

* * * * *

UNITED STATES PATENT AND TRADEMARK OFFICE

CERTIFICATE OF CORRECTION

PATENT NO. : 6,572,472 B1
DATED : June 3, 2003
INVENTOR(S) : Paulina Glavich

It is certified that error appears in the above-identified patent and that said Letters Patent is hereby corrected as shown below:

Column 2,
Line 17, change "the game include" to -- the game includes --.

Column 4,
Lines 1-2, change "plurality of smaller display could combine to form display 32 and used" to -- a plurality of smaller displays could combine to form display 32 and be used --.

Column 7,
Line 53, change "creates the credit path" to -- create the credit path --.
Lines 64-65, change "other terminating position" to -- other terminating positions --.

Column 8,
Line 33, change "invention offer players" to -- invention offers players --.

Column 10,
Line 15, change "starts and a final terminating position, where" to -- starts and a final terminating position where --.

Signed and Sealed this

Fifth Day of August, 2003

JAMES E. ROGAN
*Director of the United States Patent and Trademark Office*